United States Patent [19]

Nishikawa

[11] Patent Number: 4,518,247

[45] Date of Patent: May 21, 1985

[54] APPARATUS FOR FORMING IMAGE BY DEVELOPING CHARGE LATENT IMAGE WITH TONER

[75] Inventor: Masaji Nishikawa, Hachioji, Japan

[73] Assignee: Olympus Optical Company Limited, Tokyo, Japan

[21] Appl. No.: 502,702

[22] Filed: Jun. 9, 1983

[30] Foreign Application Priority Data

Jun. 11, 1982 [JP] Japan ..... 57-99346

[51] Int. Cl.[3] ..... G03G 15/08

[52] U.S. Cl. ..... 355/15; 355/3 DD

[58] Field of Search ..... 355/15, 3 DD, 14 D; 118/652; 430/125

[56] References Cited

U.S. PATENT DOCUMENTS

| | | | |
|---|---|---|---|
| 3,552,850 | 1/1971 | Royka et al. | 355/3 R X |
| 4,111,545 | 9/1978 | Meltzer | 355/15 |
| 4,140,388 | 2/1979 | Ikesue | 355/15 |
| 4,145,137 | 3/1979 | Sunaga et al. | 355/15 |
| 4,158,498 | 6/1979 | Ohmori | 355/15 |
| 4,174,172 | 11/1979 | Lane | 355/15 |
| 4,218,132 | 8/1980 | Iwai et al. | 355/15 |
| 4,284,345 | 8/1981 | Sugiyama et al. | 355/15 |
| 4,357,098 | 11/1982 | Endo | 355/15 |

*Primary Examiner*—A. C. Prescott

*Attorney, Agent, or Firm*—Fleit, Jacobson, Cohn & Price

[57] ABSTRACT

An electrophotographic copying machine having a photosensitive drum is disclosed. Around the drum there are arranged a corona charger for uniformly charging the drum, an optical system for projecting an image of a document onto the uniformly charged drum to form an electrostatic charge latent image, a magnetic brush developing device for developing the latent image with a two component dry developing agent to form a toner image, a transferring device for transferring the toner image onto a record paper to form a duplicated copy, and a cleaning blade for collecting a residual toner on the drum to form a toner accumulation. When the cleaning blade is separated from the drum, the toner accumulation on the drum is transported toward the developing device as the drum continues to rotate and is collected into the developing device for the recovery. The cleaning blade is separated from the drum at a timing determined by a length of record papers to be used. A continuous duplication can be performed efficiently.

6 Claims, 31 Drawing Figures

APPARATUS FOR FORMING IMAGE BY DEVELOPING CHARGE LATENT IMAGE WITH TONER

BACKGROUND OF THE INVENTION

The present invention relates to an apparatus for forming images comprising an electrostatic charge retentive member arranged rotatably, means for forming an electrostatic latent image on the charge retentive member, means for developing the latent image with a toner to form a toner image, means for transferring the toner image onto a record paper and means for removing a residual toner on the charge retentive member.

There has been developed an electrophotographic copying machine in which a charge latent image corresponding to a document image is formed on a rotatable photosensitive drum, the latent image is developed with a two component dry developer including toner and magnetic carrier to form a toner image and then the toner image is transferred onto a record paper to form a duplicated copy. In such a copying machine, after the toner image has been transferred onto the record paper, but prior to forming a new latent image for a next duplication, it is necessary to clean the photosensitive drum to remove residual toner on the drum. Heretofore, there have been proposed various kinds of cleaning devices for removing the residual toner such as a fur brush cleaning device, a blade cleaning device and a magnetic brush cleaning device. In the copying machine in which the latent image is developed with the two component dry developer, it is preferable to collect the residual toner on the drum for the recovery. In the fur brush cleaning device, since the residual toner is brushed off the drum and is collected by a filter with the aid of an air flow passing through the filter, the residual toner collected by the filter could not be used again. Further, the fur brush cleaning device is liable to be large in size and complicated in construction, because it requires large and complicated air sucking mechanism and filter. Therefore, the copying machine having such a fur brush cleaning device is also liable to be large in size. Contrary to this, in the blade cleaning device, since a blade made of elastic material such as urethane resin is brought into contact with the photosensitive drum to scrape the residual toner off the drum, the construction can be made rather small and simple. Further, the scraped residual toner can be collected for the recovery. For this purpose, the residual toner scraped off the drum by the blade is once collected in a toner receptacle and then the collected toner is transferred into the developing device by a manual operation or is automatically transported into the developing device by means of a toner transporting means having a special construction such as a flexible screw. However, in the former case, the maintenance becomes cumbersome, because the toner is difficult to handle, and in the latter case, the toner transporting means becomes complicated.

In copying machines having the magnetic brush developing device, the developing device can be commonly used as the magnetic brush cleaning device and the cleaned residual toner is automatically collected in the developing device. Therefore, it is not necessary to effect the special maintenance and to arrange the complicated device for the recovery. In this type of copying machine, the developing device is arranged between a latent image forming station and a transfer station and thus the cleaning and developing operations could not be caried out simultaneously. Therefore, even in case of forming successively a plurality of copies for a document, the photosensitive drum must be rotated by at least two revolutions for each copy and a circumferential length of the drum must be made longer than a length of a record paper. This results in that the copying speed becomes low and the copying machine becomes large in size.

In a U.S. Pat. No. 3,552,850, there has been further proposed a blade cleaning device in which the residual toner collected by a blade can be transported into a cascade developing device without providing any transporting device having a special construction. In this known cleaning device, the blade is arranged movably between two positions, in one position the blade is brought into contact with the photosensitive drum and in the other position the blade is separated from the drum. When the blade is separated from the drum, an accumulation or a mass of the collected residual toner is released from the blade and passes underneath the blade, and then the toner accumulation on the drum is transported to the developing device due to the rotation of the drum. In the above mentioned U.S. Pat. No. 3,552,850, there is further disclosed another embodiment in which the blade is always urged against the drum and two grooves are formed in the drum surface. Then the residual toner accumulated by the blade is collected by the grooves and is transported into the cascade developing device, while the drum continues to rotate.

The blade cleaning device disclosed in the U.S. Pat. No. 3,552,850 may be applied to the copying machine comprising the magnetic brush developing device using the two component dry developer. In this case, the residual toner scraped by the blade and transported to the developing device due to the rotation of the drum is collected into the developing device by means of a magnetic brush.

In the known blade cleaning device described in the U.S. Pat. No. 3,552,850, the timing at which the cleaning blade is separated from the drum and thus the timing at which the toner accumulation passes underneath the blade are fixedly determined. Therefore, in case of forming continuously a plurality of copies for a document, the drum must rotate at least one revolution, even if the length of the record paper is shorter than the circumferential length of the drum, because otherwise the toner accumulation might situate within a charge latent image and thus a duplicated copy might be deteriorated to a great extent. Nowadays, there have been developed various copying machines which can use various kinds of record papers having different lengths. In such copying machines, when a continuous duplication is effected by using short record papers, a period during which a single copy is formed can be shortened as compared with a period during which a single copy of a longer record paper is formed. In the above mentioned known blade cleaning device, since the timing at which the cleaning blade is separated from the drum is fixed, it could not be applied to the copying machines in which the duplicating period can be varied in accordance with the lengths of record papers to be used.

SUMMARY OF THE INVENTION

The present invention has for its object to provide an apparatus for forming images by developing an electrostatic latent image with a toner, in which apparatus a residual toner can be effectively collected for the recovery without affecting the image forming efficiency.

According to the invention, an apparatus for forming an image by developing an electrostatic charge latent image with a toner comprises:

means including an electrostatic charge retentive member arranged rotatably;

means for forming an electrostatic charge latent image on the charge retentive member;

means for developing the charge latent image with a toner to form a toner image on the charge retentive member;

means for transferring the toner image onto a record paper;

means having a cleaning blade selectively brought into contact with the charge retentive member for collecting a residual toner on the charge retentive member after transferring the toner image on the record paper to form a toner accumulation; and means for separating the cleaning blade from the charge retentive member at a timing determined by a length of the record paper to allow a passage of the toner accumulation underneath the cleaning blade; whereby the toner accumulation is transported to the developing means as the charge retentive member continues to rotate and is collected by the developing means for the recovery.

DESCRIPTION OF THE PREFERRED EMBODIMENTS

Figure 1:
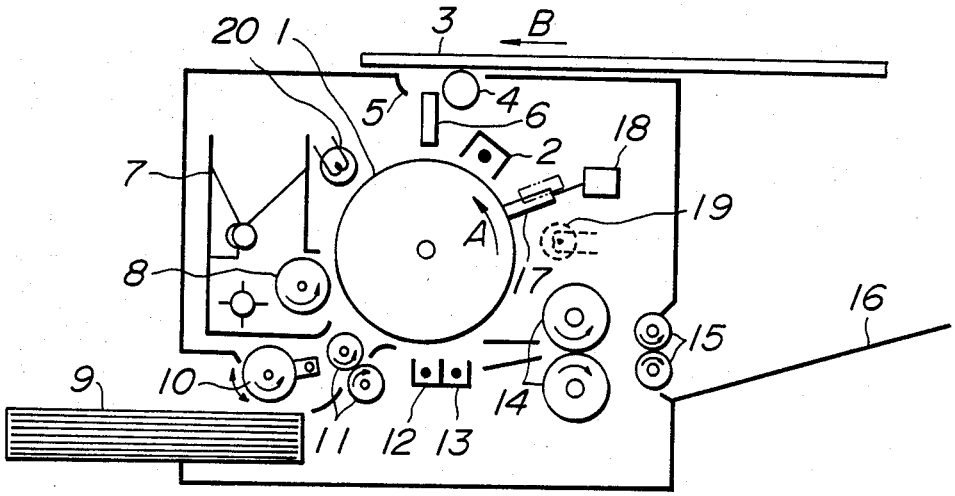
FIG. 1 is a schematic view showing one embodiment of an electrophotographic copying machine comprising the image forming apparatus according to the invention.

FIG. 1 is a schematic view showing an embodiment of the image forming apparatus according to the invention. In the present embodiment, the apparatus is constructed as an electrophotographic copying machine. In FIG. 1, when a duplicating operation is started, a photosensitive drum 1 is rotated in a direction shown by an arrow A and is uniformly charged by a corona charger 2. A document to be duplicated is placed on a document table 3 and is moved in a direction B. The document is illuminated by an illumination lamp 4 and a reflecting mirror 5 and an image of document is projected upon the drum 1 by means of a fiber lens array 6 to form an electrostatic charge latent image corresponding to the document image. The latent image on the drum 1 is developed with a two component dry developing agent by means of a magnetic brush developing device 7 having a magnetic brush roller 8. A toner image thus developed is transferred onto a record paper which is contained in a paper cassette 9 and fed by a pick-up roller 10 and feed rollers 11. At a transferring station there is provided a transferring corona charger 12. After the toner image has been transferred onto the record paper, the record paper is peeled off the drum by means of a peeling corona charger 13 and a peeling claw not shown and is further supplied to fixing rollers 14 at which the toner is fixed onto the record paper. The record paper is then discharged onto a copy tray 16.

After transferring, on the photosensitive drum 1 there is remained a residual toner. In order to remove the residual toner, there is arranged a cleaning blade 17 made of elastic material such as urethane rubber. The blade 17 is arranged movably with respect to the drum surface and is separated from the drum 1 by means of a blade driving device 18 such as a solenoid. The residual toner accumulated by the blade 17 is collected by the magnetic brush developing device 7 as will be explained later. At an upstream position with respect to the blade 17, it is preferable to arrange an erasing lamp 19 shown by a broken line. This erasing lamp may be replaced by an AC corona charger. Further, a trimming lamp 20 is arranged between the image projecting station and the developing device 7.

Figure 2A:
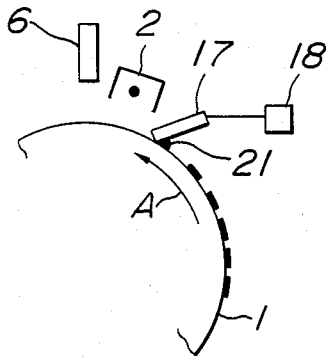
FIGS. 2A, 2B and 2C are schematics explaining an operation of a cleaning blade according to the invention.
Figure 2B:
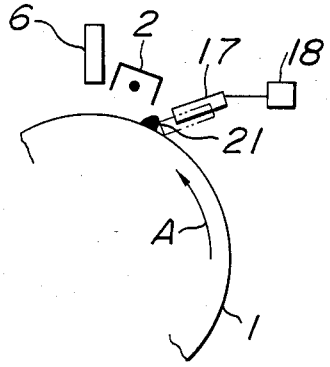
Figure 2C:
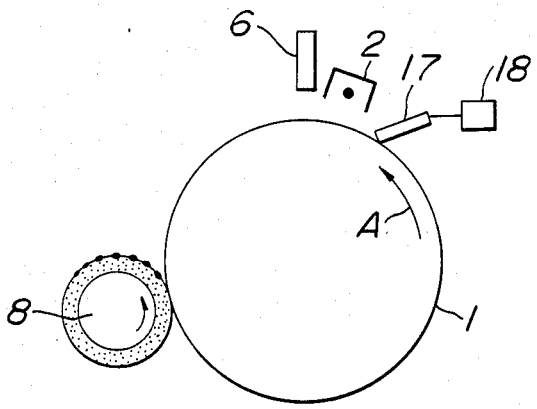
Figures 3A, 3B, 3C, 3D, 3E, 3F:
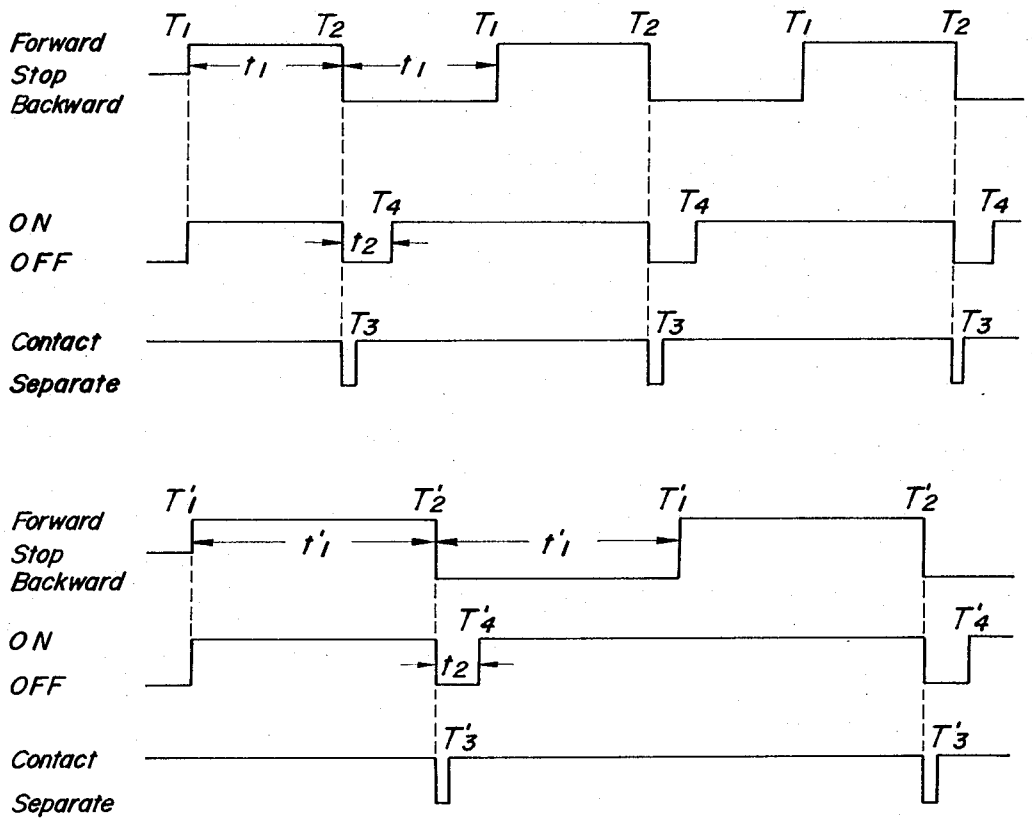
FIGS. 3A to 3F are timing charts showing an embodiment of a cleaning blade driving timing according to the invention.
Figures 4A, 4B, 4C, 4D, 4E, 4F:
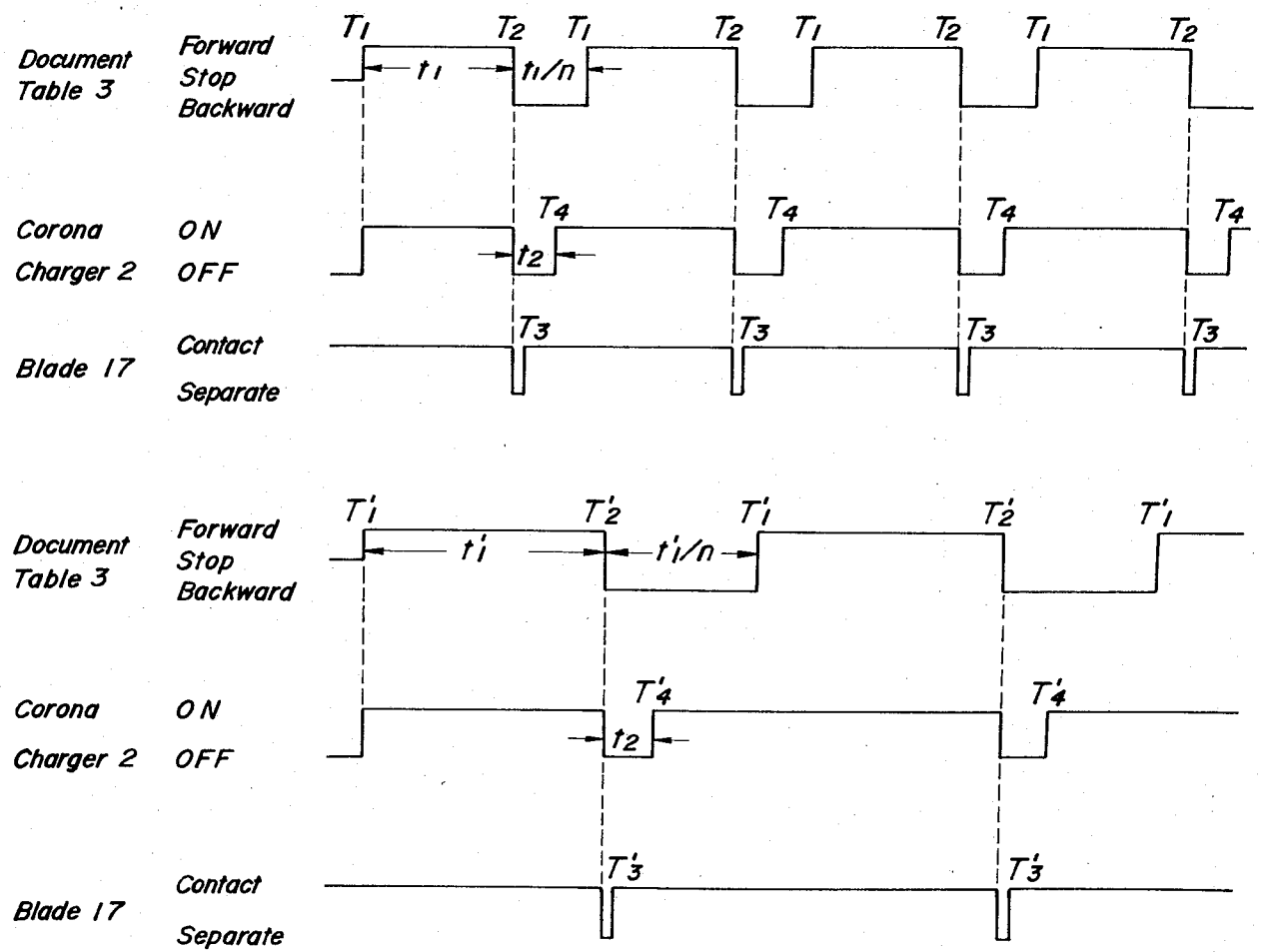
FIGS. 4A to 4F are timing charts depicting another embodiment of the cleaning blade driving timing according to the invention.
Figures 5A, 5B, 5C, 5D, 5E, 5F:
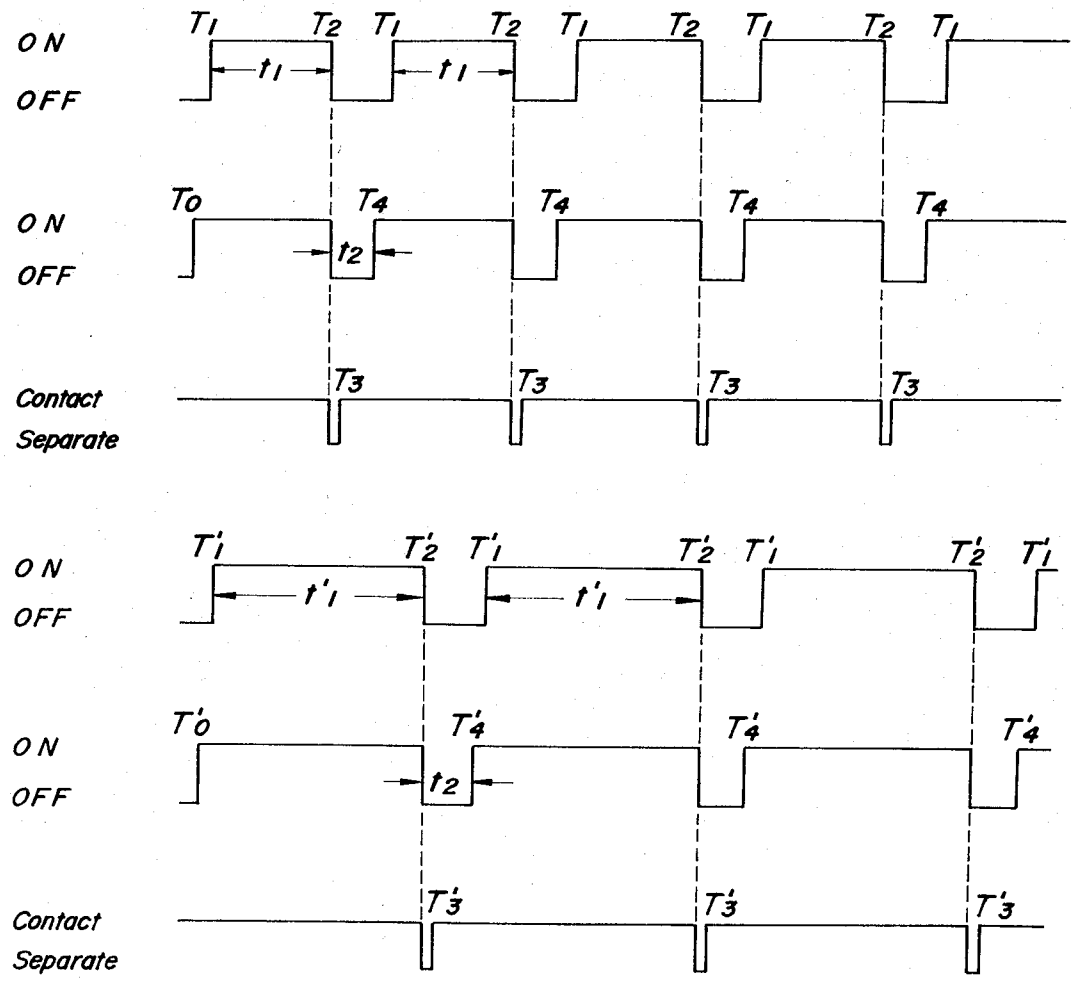
FIGS. 5A to 5F are timing charts illustrating still another embodiment of the cleaning blade driving timing according to the invention.

Now the operation of the cleaning blade will be explained with reference to FIGS. 2A, 2B and 2C. When the blade 17 is brought into contact with the drum 1 as illustrated in FIG. 2A, the residual toner remained on the drum surface is collected by the blade 17 and a toner accumulation 21 is formed in a space surrounded by the blade 17 and drum surface. When the blade driving device 18 is actuated to separate the blade 17 from the drum surface as shown in FIG. 2B, the toner accumulation 21 passes underneath the blade 17 and is transported toward the developing device as the drum continues to rotate. Then the toner accumulation 21 is removed from the drum 1 by means of the magnetic brush roller 8 and is collected into the developing device 7 as shown in FIG. 3C.

The toner accumulation 21 is liable to be easily removed from the drum 1, because the toner accumulation 21 is formed as a thick layer, in which an air has been contained and an electrostatic atractive force is not generated between the toner accumulation and drum 1. Therefore, the toner accumulation 21 can be easily removed from the drum 1 by the magnetic brush roller 8. This results in that the toner accumulation 21 can be effectively collected by the developing device 7 without taking any special measures such as an increase of a developing bias voltage.

It should be noted that in the image forming apparatus according to the invention use may be made of not only the two component dry magnetic developing system, but also a single component dry magnetic developing system and a fur brush developing system may be used without producing any difficult. It is preferable that a space between the photosensitive member and a sleeve for maintaining and carrying the developing agent is relatively large. Moreover, the toner accumulation may be collected by any mechanical or physical means other than the magnetic brush roller 8. For instance, at an upstream position with respect to magnetic brush roller is arranged a toner scraper for collecting the toner accumulation from the photosensitive drum into a toner hopper or the developing device. In this case, the front edge of the scraper may be brought into contact with the drum or may be slightly separated from the drum.

According to the invention, in order to effect the image forming operation efficiently, the cleaning blade is brought into contact with and separated from the charge retentive member in accordance with the length of the record paper. As will be explained in detail hereinbelow, the image forming apparatus can be advantageously applied to various types of copying machines in which a distance over which a document table or a scanning optical system is travelled can be controlled in accordance with the length of the record paper, the document table or scanning optical system is returned to a home position at a higher speed, or a document is fed through a fixed scanning optical system by means of a document feeder. Further, the image forming apparatus according to the invention can also be applied to devices other than the electrophotographic copying machine such as an electrostatic recorder, electrophotographic printer and electrophotographic facsimil.

FIGS. 3A to 3F are timing charts for explaining the operation of the document table 3, corona charger 2 and cleaning blade 17 of the copying machine shown in FIG. 1. In this copying machine, the document table 3 is reciprocated over a variable distance corresponding to the length of the record paper. That is to say, when use is made of the record paper having a shorter length, the document table is reciprocated over a shorter distance.

FIGS. 3A to 3C show the duplicating operation for forming continuously a plurality of copies of the short length. At a timing $T_1$, a copy start switch is actuated and the corona charger 2 is energized. At the same time, the document table 3 which is in a home position is moved forward. At this time, the cleaning blade 17 has been brought into contact with the drum 1. While the table is moved forward for a period $t_1$, the document is scanned. At the end $T_2$ of the scanning operation for a document on the table, the document table is then moved backward. At this timing $T_2$ the corona charger 2 is once deenergized and the cleaning blade 17 is once separated from the drum 1. The cleaning balde is brought into contact with the drum at a timing $T_3$ after the timing $T_2$. Then the toner accumulation 21 on the drum is transported to the developing device and is collected by the developing device. At a timing $T_4$ by which at the latest the toner accumulation 21 has passed through the corona charger 2, the corona charger is again energized. In this manner, the toner accumulation can be prevented from being charged undesiably. After the document table 3 returns into the home position, a duplicating cycle for a next copy is started. There can be obtained an enough time for separating the cleaning blade 17 from the drum during a time period $t_1$ in which the table returns into the home position. As explained above, successive copies can be formed efficiently with the duplicating period of $2t_1$.

FIGS. 3D to 3F show similar timing charts explaining the duplicating operation for forming continuously successive copies having a longer length. At a timing $T_1'$ the copy start switch is actuated to initiate the forward movement of the document table 3. Since the copy has a longer length the forward movement lasts for a longer period $t_1'$. At a timing $T_2'$, the document table is then moved backward to the home position. At the same time, the corona charger 2 is once deenergized and the cleaning blade 17 is once separated from the drum 1. At a timing $T_3'$ after the timing $T_2'$, the cleaning blade 17 is again brought into contact with the drum. At a timing $T_4'$, the corona charger 2 is energized again. The period between the timings $T_2'$ and $T_4'$ is equal to the period $t_2$ from $T_2$ to $T_4$.

Upon compare the timing charts shown in FIGS. 3A to 3F, it is apparent that when use is made of the short record papers, the successive copying operations can be effected with the short period $2t_1$. In this manner, according to the invention, the continuous duplicating operation can be performed efficiently in accordance with the size of the record papers. In other words, according to the invention the duplication period can have any desired values $2t_1$ and $2t_1'$.

FIGS. 4A to 4F are timing charts similar to those shown in FIGS. 3A to 3F. In this embodiment, the document table 3 can be moved backward at a faster speed by n ($n>1$) than a forward movement speed. Therefore, successive copies can be formed with a higher efficiency than that shown in FIGS. 3A to 3F. At a timing $T_1$, the document table is moved forward and after a period $t_1$ the document table is moved backward at a timing $T_2$. At the same time, the corona charger 2 is once deenergized and the blade 17 is separated from the drum instantaneously. At a timing $T_4$, the corona charger is energized again. The document table returns into the home position within a short period of $t_1/n$. In case of using longer record papers, the document table is moved forward for a period $t_1'$ and then is moved backward for a short period $t_1'/n$. Also in this embodiment, the successive copies can be obtained efficiently within a short time.

In the embodiments shown in FIGS. 3A to 3F and 4A to 4F, the document table is reciprocated over the variable distance corresponding to the length of record papers. It should be noted that the same timing control can be applied to a duplicating machine in which a document is scanned by reciprocating an optical system over a variable distance corresponding to the record paper length.

FIGS. 5A to 5F are timing charts for explaining the operation of still another embodiment of the image forming apparatus according to the invention. In this embodiment, a document is scanned by moving the document by means of rollers of a document feeder. At a timing $T_o$ or $T_0'$, a copy start switch is actuated and a corona charger is energized. At a timing $T_1$ or $T_1'$, the exposing and scanning operation is initiated. At a timing $T_2$ or $T_2'$, the scanning operation is finished and the corona charger is once deenergized. At the same time, the cleaning blade is once separated from the photosensitive drum until a timing $T_3$ or $T_3'$. After a period $t_2$ or $t_2'$, the corona charger is energized again at a timing $T_4$ or $T_4'$. Also in this embodiment, by controlling the timing for moving the cleaning blade in response to the length of the record papers, it is possible to form successive copies efficiently. In should be noted that timing control of this embodiment may be equally applied to an electrostatic printer in which an input signal is continuously supplied.

It is a matter of course that the cleaning system according to the invention can be applied not only to the electrophotographic copying machine, but also to a transferring type electrostatic recorder in which an electrostatic latent image is directly formed on an insulating medium and is then developed to form a toner image and the toner image is transferred onto a record paper. In such an application, the charging and exposing processes are replaced by an electrostatic recording process. For instance, the latent image may be formed by means of a multi-stylus electrode or by modulating a secondary ion flow by a latent image formed on a photosensitive screen.

Next, a few embodiments of an electric circuit for effecting the above explained timing control will be explained.

Figure 6:
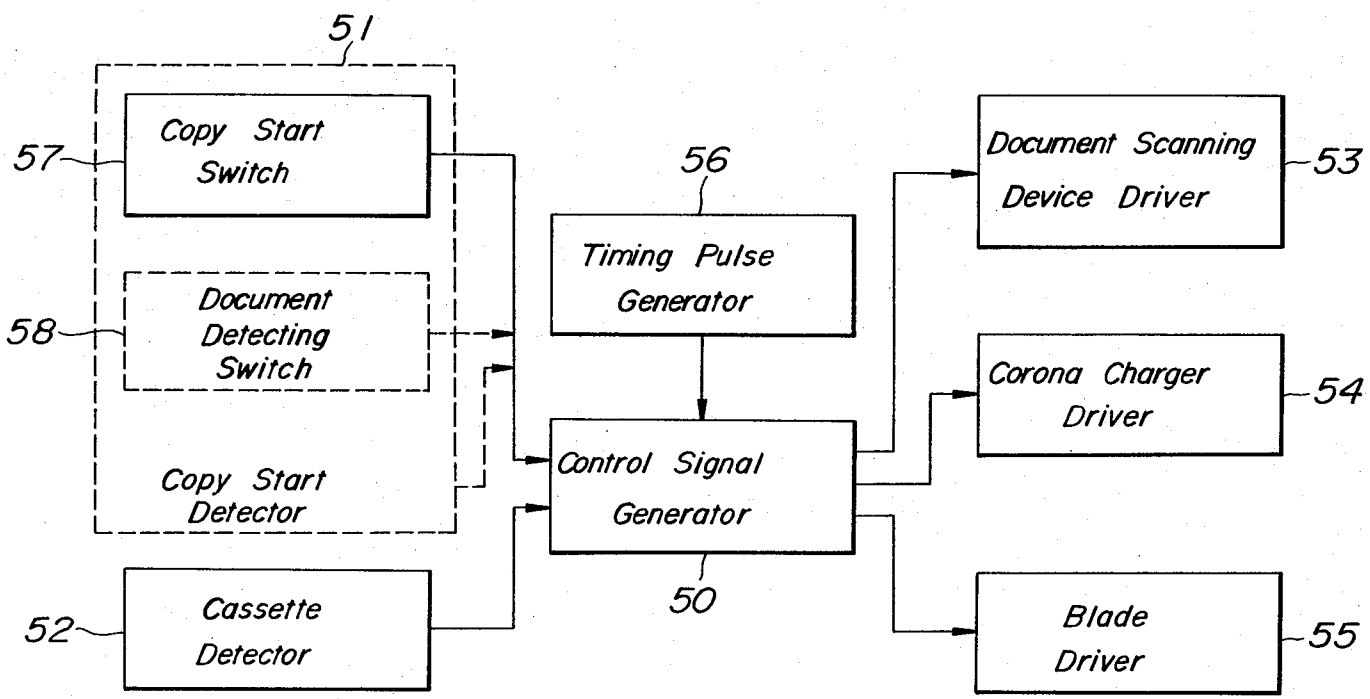
FIGS. 6, 7 and 8 are block diagrams showing three embodiments of a timing control circuit according to the invention.

FIG. 6 is a block diagram illustrating a first embodiment of the timing control circuit. In this embodiment, information denoting the size of record papers to be used in derived from a signal identifying record paper cassettes and the timing $T_2$, $T_2'$ and $T_3$, $T_3'$ for controlling the cleaning blade driving device are determined by the information. There is provided a control signal generator 50 for generating various control signals necessary for the image formation. The control signal generator 50 receives a start signal supplied from a copy start detector 51 and a cassette identification signal from a cassette detector 52 and supplies driving signals at given timings to a driver 53 for driving a document scanning device such as the document table and scanning optical system, a corona charger driver 54 for driving the corona charger for uniformly charging a charge retentive member and to a blade driver 55 for driving the cleaning blade. Clock pulses necessary for generating the driving signals are supplied from a timing pulse generator 56 to the control signal generator 50. The timing pulse generator 56 is operated in synchronism with the photosensitive member and produces the clock pulses having a given period. In the control signal generator 50, the clock pulses are counted by a counter and a count value is compared with various preset values which are determined in accordance with the given control timings. When the count value becomes equal to a preset value, a control signal is generated.

The copy start signal may be produced from a copy start switch 57. In a copying machine comprising a document feeder, the copy start signal may be produced by a document detecting switch provided in the document feeder for detecting an insertion of a document into the document feeder. Further in case of the continuous duplication for forming continuously a plurality of copies of the same and single document, the copy start signal may be generated by a copy end signal of a preceding copying operation. Further, in the electrostatic printer in which the signal to be recorded is supplied serially, the start signal may be formed by a page start signal which is supplied for each page. According to the present embodiment, the cassette detector must identify the length of the record papers contained in the paper cassette.

Figure 7:
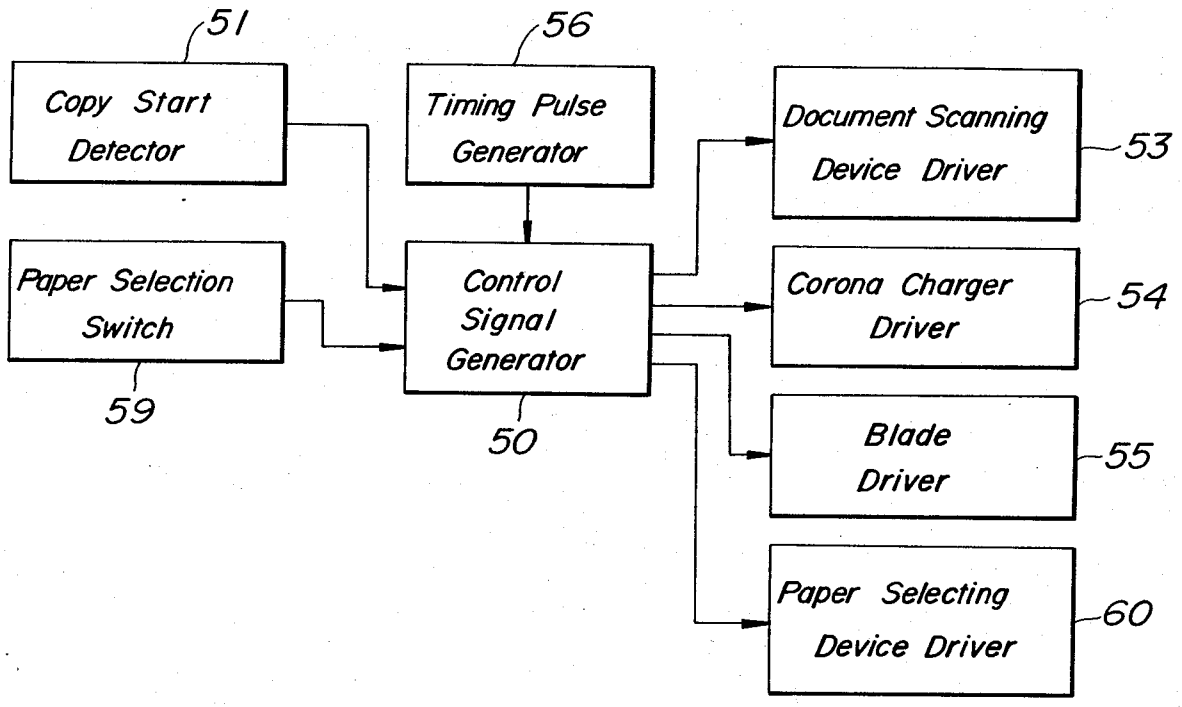

FIG. 7 is a block diagram illustrating a second embodiment of the timing control circuit according to the invention. In this embodiment, any one of different sizes of record papers having different lengths can be selected by operating a paper selection switch 59. A paper selection signal is supplied from the paper selection switch 59 to a control signal generator 50 which then supplies a blade control signal to a blade driver 55 at suitable timings. In the present embodiment, the control signal generator 50 further supplies a pape selection control signal to a paper selecting device driver 60 to select desired record papers selected by the paper selection switch 59.

Figure 8:
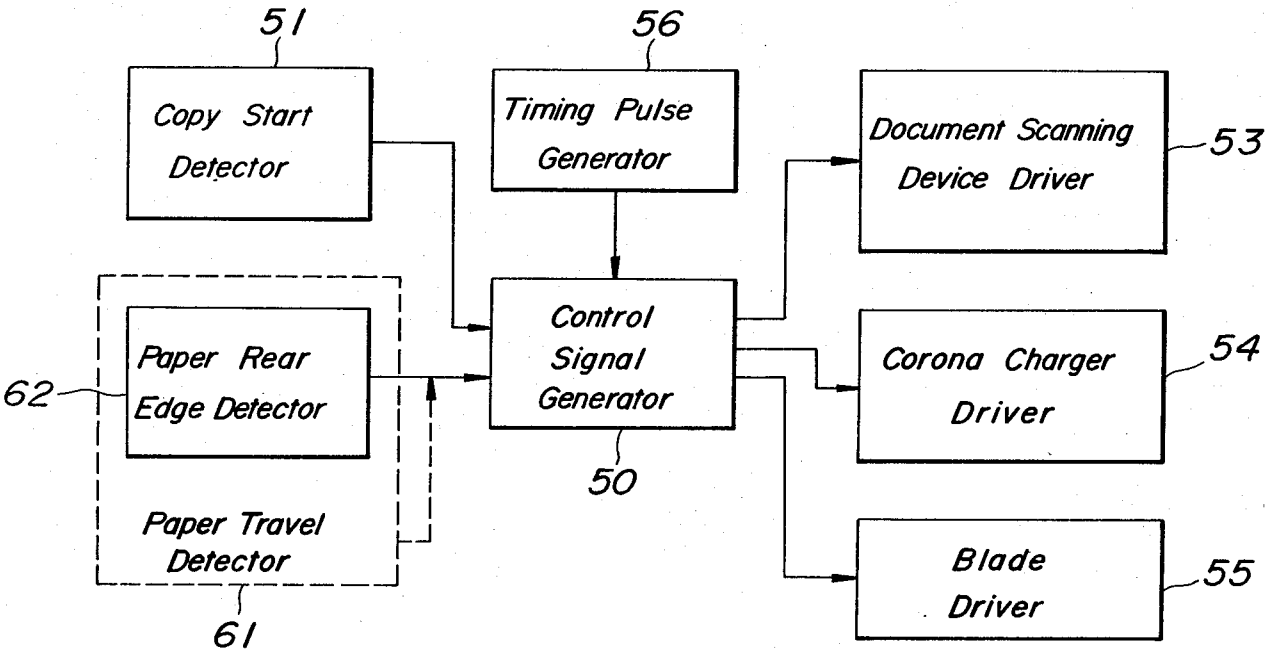
Figures 9A, 9B, 9C, 9D, 9E, 9F:
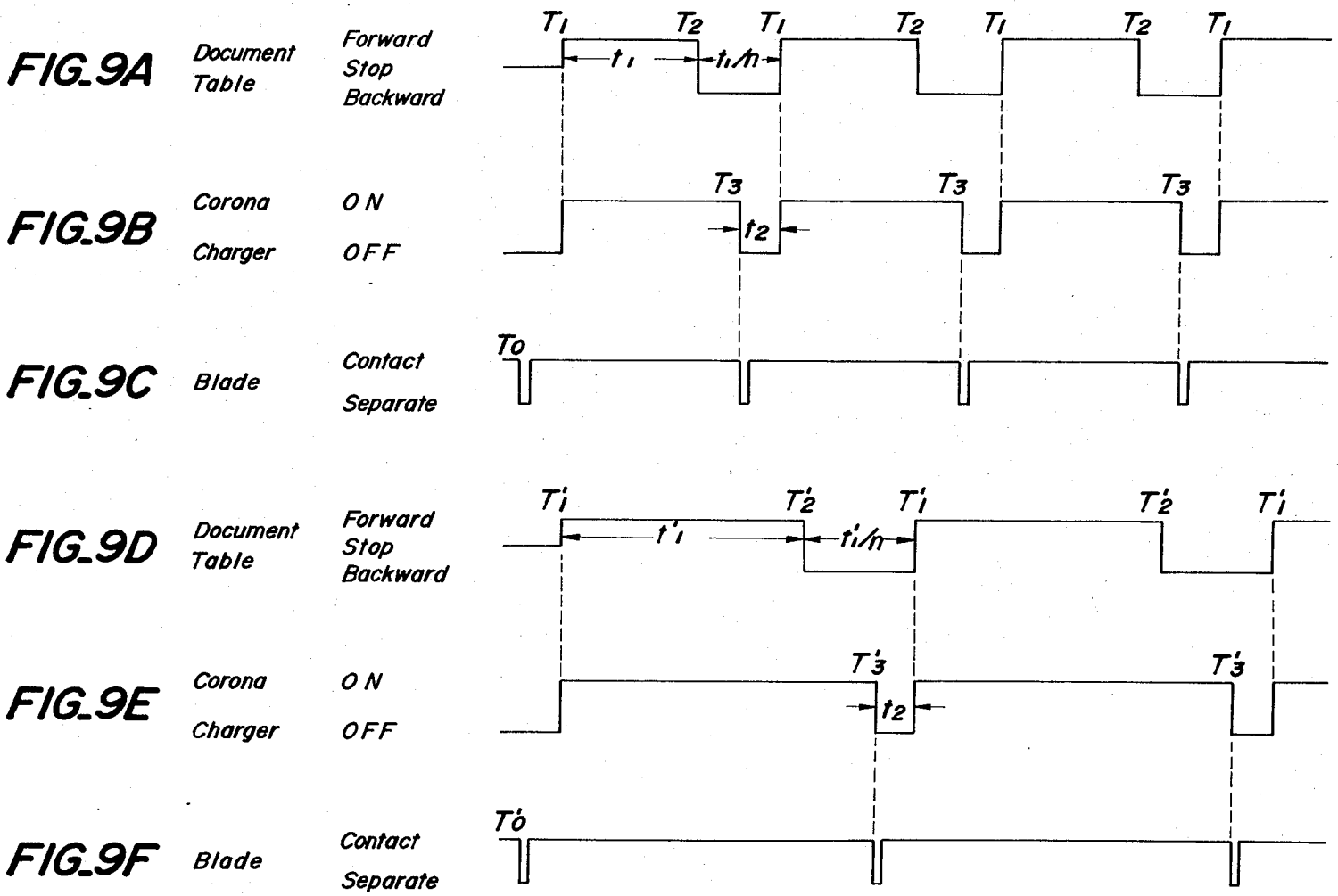
FIGS. 9A to 9F are timing charts illustrating still another embodiment of the cleaning blade driving timing according to the invention.

FIG. 8 is a block diagram showing a third embodiment of the timing controlling circuit according to the invention. In the present embodiment, the blade is controlled by detecting the travelling record paper. This type of the controlling circuit can be advantageously applied to a copying machine in which record papers to be used can be manually supplied into the machine. A paper travel detector 61 comprises a sensor arranged in a travelling path of the record paper. For instance, a detector 62 for detecting a rear edge of the record paper moving along the travelling path is arranged in the paper travel detector 61. The control signal generator 50 generates the required control signals in response to a detection signal supplied from the paper rear edge detector 62. It should be noted that the paper travel detector 61 may comprise a paper front edge detector as will be explained later.

In the embodiments so far explained, the cleaning blade is once separated from the photosensitive drum at the end of the duplicating operation. However, according to the invention, the cleaning blade may be once separated from the photosensitive drum at a start timing of the duplicating operation. Those skilled in the art could easily change the control circuit for this purpose. FIGS. 9A to 9F are timing charts illustrating the operation of various parts in such a modified embodiment. This embodiment is similar to that shown in FIGS. 4A to 4F and the document table is moved backward at a faster speed. At a copy start timing $T_0$ or $T_0'$, the cleaning blade is once separated from the photosensitive drum to allow the toner accumulation to pass underneath the blade. After the toner accumulation has passed through the corona charger, the document table is initiated to move forward and the corona charger is energized at a timing $T_1$ or $T_1'$. Then the image forming operation is started. At a timing $T_2$ or $T_2'$, the document table is returned toward the home position. During this return movement, a copy start signal for a next copy is generated at a timing $T_3$ or $T_3'$ and the cleaning blade is once again separated from the drum and the corona charger is deenergized. In this manner, the continuous duplication can be effected efficiently, while the cleaning blade is moved at suitable timings in accordance with the length of record papers to be used.

As explained above in detail, according to the invention, the residual toner on the photosensitive member is collected by the cleaning blade to form the toner accumulation and the toner accumulation is transported into the developing device by separating the cleaning blade from the photosensitive member at the suitable timings which are determined in accordance with the length of record papers to be used. Therefore, the residual toner can be easily and positively collected into the developing device for the recovery, while the continuous image forming operation can be performed in an extremely efficient manner.

It should be noted that the period during which the cleaning blade is separated from the photosensitive member may be made much longer than that in the above explained embodiments as long as a new latent image formation is not disturbed.

What is claimed is:

1. An apparatus for forming an image by developing an electrostatic charge latent image with a toner comprising means including an electrostatic charge retentive member arranged rotatably;

means for forming an electrostatic charge latent image on the charge retentive member;

means for developing the charge latent image with a toner to form a toner image on the charge retentive member;

means for transferring the toner image onto a record paper;

means having a cleaning blade selectively brought into contact with the charge retentive member for collecting a residual toner on the charge retentive member after transferring the toner image on the record paper to form a toner accumulation; and means for separating the cleaning blade from the charge retentive member at a timing determined by a length of the record paper to allow a passage of the toner accumulation underneath the cleaning blade; whereby the toner accumulation is transported to the developing means as the charge retentive member continues to rotate and is collected by the developing means for the recovery.

2. An apparatus according to claim 1, wherein said cleaning blade separating means comprises means for detecting an end timing of an image forming operation for forming respective images to produce an end signal and the cleaning blade is separated from the charge retentive chamber in response to said end signal.

3. An apparatus according to claim 2, wherein said end timing detecting means comprises means for detecting a cassette containing record papers to be used to produce a cassette identification signal, means for detecting a start timing of the image forming operation to produce a start signal, and means for generating said end signal in response to said cassette identification signal and start signal.

4. An apparatus according to claim 2, wherein said end timing detecting means comprises means for detecting record papers to be used to produce a record paper identification signal, means for detecting a start timing of the image forming operation to produce a start signal, and means for generating said end signal in response to said record paper identification signal and start signal.

5. An apparatus according to claim 2, wherein said end timing detecting means comprises means for detecting a rear edge of a record paper travelling in the apparatus to produce a rear edge signal, and means for generating said end signal in response to said rear edge signal.

6. An apparatus according to claim 1, wherein said cleaning blade separating means comprises means for detecting a start timing of an image forming operation for forming respective images to produce a start signal and the cleaning blade is separated from the charge retentive member in response to said start signal.

* * * * *